US009102162B2

(12) United States Patent
Watanabe et al.

(10) Patent No.: US 9,102,162 B2
(45) Date of Patent: Aug. 11, 2015

(54) INKJET PRINTING APPARATUS

(71) Applicant: CANON KABUSHIKI KAISHA, Tokyo (JP)

(72) Inventors: Shigeru Watanabe, Yokohama (JP); Naoaki Wada, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/782,575

(22) Filed: Mar. 1, 2013

(65) Prior Publication Data

US 2013/0235133 A1 Sep. 12, 2013

(30) Foreign Application Priority Data

Mar. 9, 2012 (JP) ..... 2012-052744

(51) Int. Cl.
*B41J 2/19* (2006.01)
*B41J 2/165* (2006.01)
*B41J 2/175* (2006.01)

(52) U.S. Cl.
CPC ..... *B41J 2/19* (2013.01); *B41J 2/16532* (2013.01); *B41J 2/17509* (2013.01)

(58) Field of Classification Search
USPC ..... 347/92
See application file for complete search history.

(56) References Cited

U.S. PATENT DOCUMENTS

| | | | | |
|---|---|---|---|---|
| 2003/0007049 | A1 | 1/2003 | Hino | 347/92 |
| 2003/0052950 | A1* | 3/2003 | Ohashi et al. | 347/85 |
| 2004/0012648 | A1 | 1/2004 | Mizoguchi et al. | 347/19 |
| 2004/0061748 | A1* | 4/2004 | Kuwabara et al. | 347/85 |
| 2006/0164478 | A1* | 7/2006 | Fukazawa | 347/85 |
| 2009/0267976 | A1 | 10/2009 | Lee et al. | 347/6 |
| 2010/0231621 | A1* | 9/2010 | Watanabe et al. | 347/7 |
| 2010/0231662 | A1* | 9/2010 | Ara et al. | 347/85 |

FOREIGN PATENT DOCUMENTS

| | | |
|---|---|---|
| CN | 1533330 | 9/2004 |
| JP | 2007-203649 | 8/2007 |
| JP | 2008-168563 | 7/2008 |
| JP | 2010-208151 | 9/2010 |

OTHER PUBLICATIONS

Chinese Office Action dated Aug. 28, 2014, in counterpart Chinese Patent Application No. 201310076968.8, together with English language translation thereof.

* cited by examiner

*Primary Examiner* — Stephen Meier
*Assistant Examiner* — Alexander D Shenderov
(74) *Attorney, Agent, or Firm* — Fitzpatrick, Cella, Harper & Scinto

(57) ABSTRACT

The present invention provides an inkjet printing apparatus capable of achieving thorough stirring by producing a flow in a main tank and a sub tank. The inkjet printing apparatus includes a printing head, a main tank, and a sub tank. The apparatus includes an ink reservoir unit formed of a flexible member, disposed between the sub tank and the printing head. The ink is supplied from the sub tank to the printing head by increasing the volume of the ink reservoir unit, and air in the sub tank is sent to the main tank by reducing the volume of the ink reservoir unit.

18 Claims, 9 Drawing Sheets

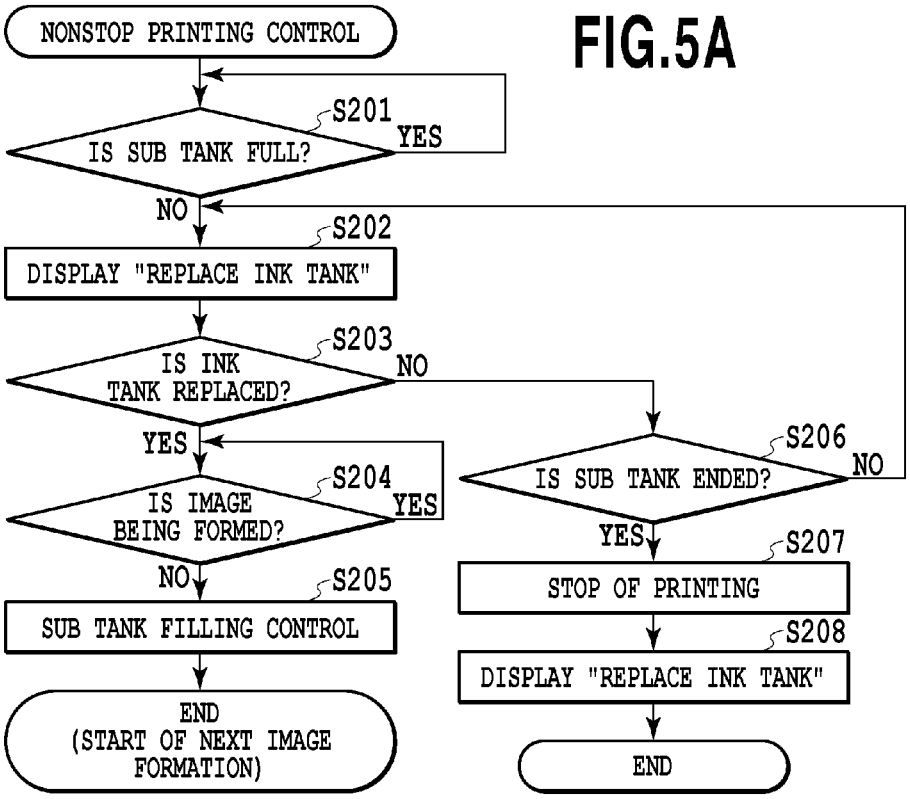
FIG.5A
NONSTOP PRINTING CONTROL
S201
IS SUB TANK FULL?
YES
NO
S202
DISPLAY "REPLACE INK TANK"
S203
IS INK TANK REPLACED?
NO
YES
S204
IS IMAGE BEING FORMED?
YES
NO
S205
SUB TANK FILLING CONTROL
END (START OF NEXT IMAGE FORMATION)
S206
IS SUB TANK ENDED?
NO
YES
S207
STOP OF PRINTING
S208
DISPLAY "REPLACE INK TANK"
END

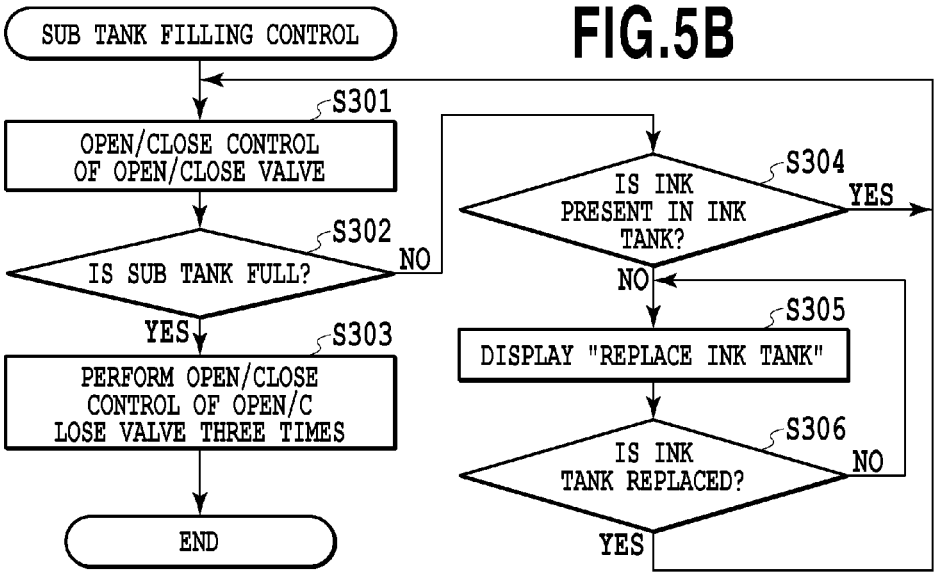
FIG.5B
SUB TANK FILLING CONTROL
S301
OPEN/CLOSE CONTROL OF OPEN/CLOSE VALVE
S302
IS SUB TANK FULL?
NO
YES
S303
PERFORM OPEN/CLOSE CONTROL OF OPEN/C LOSE VALVE THREE TIMES
END
S304
IS INK PRESENT IN INK TANK?
YES
NO
S305
DISPLAY "REPLACE INK TANK"
S306
IS INK TANK REPLACED?
NO
YES

INKJET PRINTING APPARATUS

BACKGROUND OF THE INVENTION

1. Field of the Invention

The present invention relates to an inkjet printing apparatus and more particularly to an inkjet printing apparatus in which the contents of an ink tank are stirred.

2. Description of the Related Art

An inkjet printing apparatus may use pigment ink for printing. If the pigment ink is left as it is, pigment ingredients are settled out in an ink tank, resulting in uneven concentration distribution in the ink tank. Printing using the ink tank in which the concentration distribution is uneven may cause unevenness in density in a printed image and hence image quality degradation.

Japanese Patent Laid-Open No. 2010-208151 discloses a technique for a printing apparatus including a sub tank and a main tank, in which the contents of an ink tank filled with pigment ink are stirred at regular intervals. In the printing apparatus disclosed in Japanese Patent Laid-Open No. 2010-208151, the sub tank is provided with an atmosphere communicating passage communicating with the atmosphere, and an air chamber is provided in the atmosphere communicating passage so as to prevent the ink from leaking through the atmosphere communicating passage. In addition, an atmosphere communicating valve is disposed in an opening communicating with the atmosphere in the atmosphere communicating passage. In such a printing apparatus, the atmosphere communicating valve is closed, and an open/close valve in an ink flow path is opened and closed to produce a flow of the ink in the ink tank and the sub tank and thereby stir the ink.

According to Japanese Patent Laid-Open No. 2010-208151, as described above, the flow of the ink in the main tank and the sub tank is utilized to stir the ink in the ink tank, thereby suppressing unevenness in density due to unevenness of concentration distribution in the ink tank.

In the inkjet printing apparatus disclosed in Japanese Patent Laid-Open No. 2010-208151, however, air is always present between the sub tank and the atmosphere communicating valve. Therefore, even if an attempt is made to stir the ink by producing the flow in the main tank and the sub tank by opening and closing the open/close valve, the air between the sub tank and the atmosphere communicating valve acts as a damper to reduce stirring efficiency.

Consequently, there exists a problem of the flow taking place unsuccessfully in the ink tank, resulting in insufficient stirring.

SUMMARY OF THE INVENTION

The present invention has been made in view of the above. An object of the present invention is to provide an inkjet printing apparatus capable of achieving thorough stirring by producing a flow in a main tank and a sub tank.

In order to attain the above object, the present invention provides an inkjet printing apparatus including a printing head configured to eject ink, a main tank storing the ink to be supplied to the printing head and being attachable to and detachable from an apparatus body, and a sub tank configured to temporarily store the ink to be supplied from the main tank to the printing head, including an ink reservoir unit formed of a flexible member, disposed between the sub tank and the printing head, in which the ink is supplied from the sub tank to the printing head by increasing the volume of the ink reservoir unit, and air in the sub tank is sent to the main tank by reducing the volume of the ink reservoir unit.

According to the above configuration, it is possible to let air out of a sub tank with no atmosphere communicating passage provided to the sub tank. As a result, it is possible to provide an inkjet printing apparatus capable of nonstop printing, including a sub tank, which suppresses leakage of ink and is good in space efficiency and thus is not large in size.

Further features of the present invention will become apparent from the following description of exemplary embodiments (with reference to the attached drawings).

BRIEF DESCRIPTION OF THE DRAWINGS

FIGS. 5A and 5B are flowcharts illustrating a flow of nonstop printing control of the embodiment;

DESCRIPTION OF THE EMBODIMENTS

An embodiment of the present invention will be described in detail below with reference to the drawings.

Figure 1:
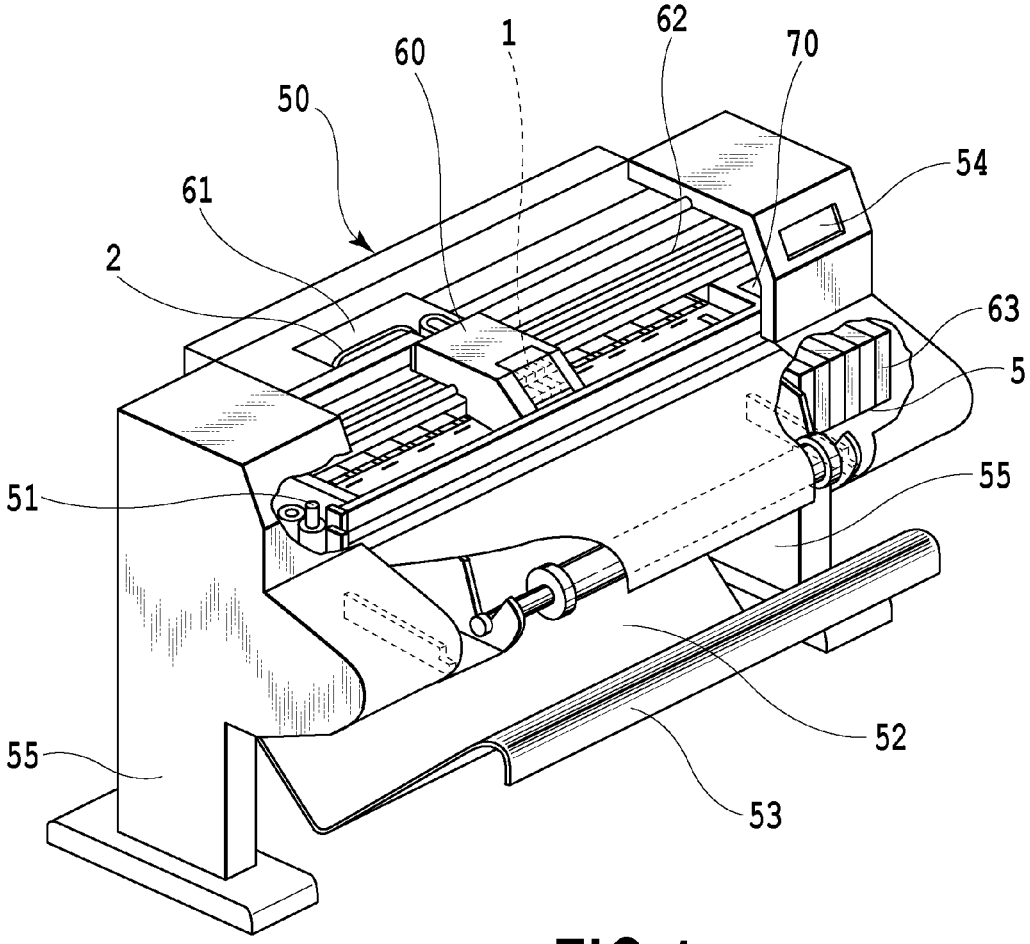
FIG. 1 is a perspective view illustrating an inkjet printing apparatus of an embodiment.

FIG. 1 is a perspective view illustrating an inkjet printing apparatus of the embodiment. An inkjet printing apparatus 50 is fixed in such a way as to straddle upper end portions of two legs 55 facing each other. A printing head 1 for applying ink to a printing medium is mounted on a carriage 60. At the time of printing, the printing medium placed in a carrying roll holder unit 52 is fed to a printing position, and the carriage 60 moves to back and forth in a main scanning direction by a carriage motor (unillustrated) and belt transmission means 62. During this movement, printing operation is performed to eject ink droplets from nozzles of the printing head 1. When the carriage 60 moves to one end of the printing medium, a conveying roller 51 conveys the printing medium by a predetermined amount in a sub scanning direction. An image is formed throughout the entire area of the printing medium by repeating alternately the printing operation and conveying operation in this manner. Afterimage formation, the printing medium is cut by a cutter (unillustrated), and the cut printing medium is stacked on a stacker 53.

An ink supply unit 63 includes an ink tank 5 storing ink, which is attachable to and detachable from an apparatus body and provided separately for each of ink colors such as black, cyan, magenta and yellow. In addition, the ink tank 5 is connected to supply tubes 2. Moreover, the supply tubes 2 are tied in a bundle by a tube guide 61 so as not to make an undesirable motion during back and forth movements of the carriage 60.

A surface of the printing head 1 facing the printing medium is provided with a plurality of nozzle arrays (unillustrated) in a direction substantially orthogonal to the main scanning direction, and the printing head 1 is connected to the supply tubes 2 in nozzle array units.

A recovery unit 70 is provided outside a range of the printing medium in the main scanning direction and also is disposed at a position capable of facing the nozzle surface of the printing head 1. The recovery unit 70 performs cleaning of the nozzles by sucking out the ink or air from the ejecting nozzle surface of the printing head 1, or performs valve-closing sucking for forcefully sucking out air accumulated in the printing head, to be described later, as needed.

The right side of the printing apparatus 50 is provided with an operating panel 54 so that, when the ink tank 5 becomes empty of ink, a warning can be issued to urge a user to replace the ink tank 5.

Figure 2:
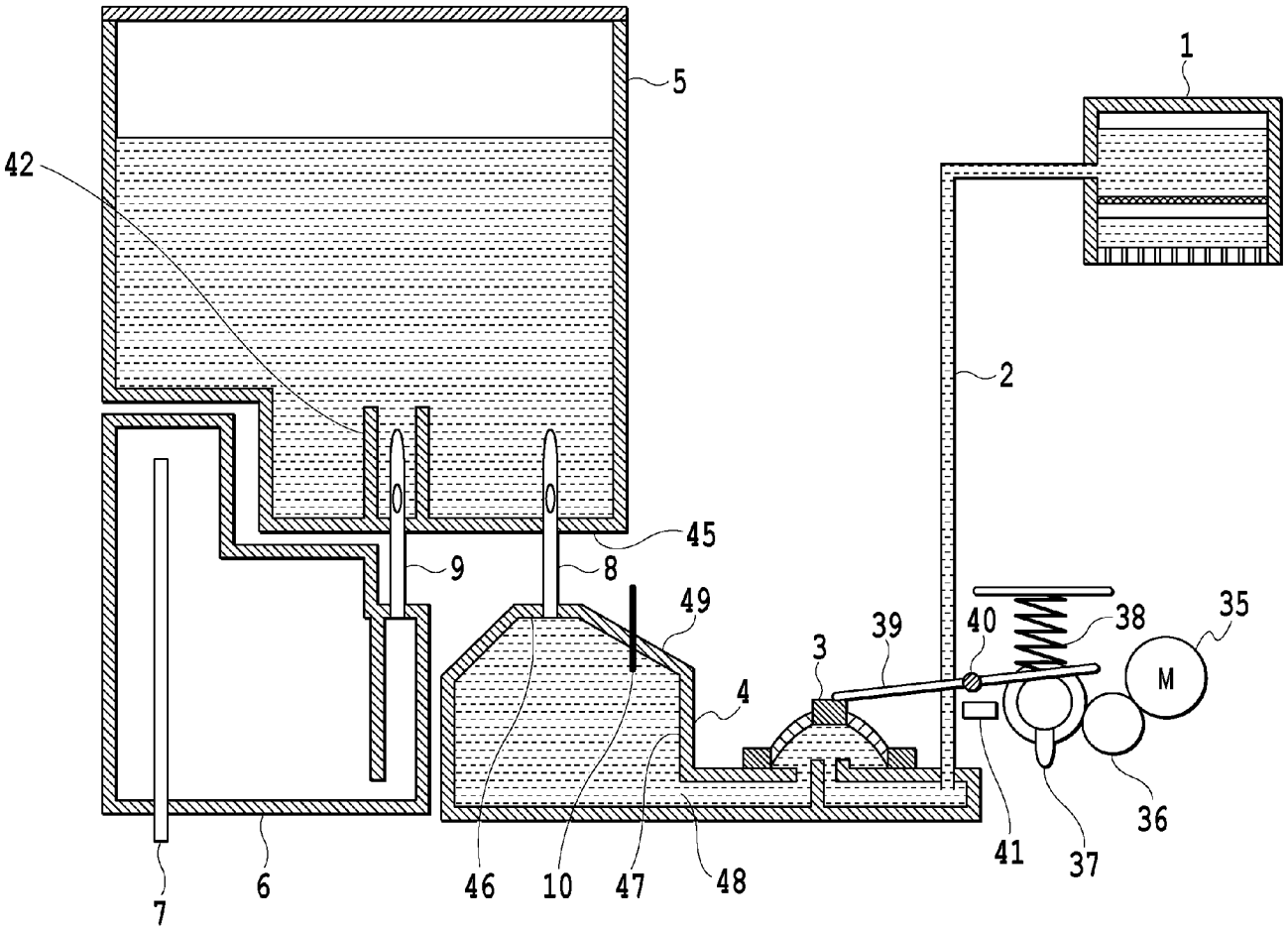
FIG. 2 is a conceptual drawing illustrating a flow path for a color of ink in an ink supply device of the embodiment.

FIG. 2 is a conceptual drawing illustrating a flow path for a color of ink in an ink supply device of the embodiment. The ink tank 5 having a constant volume, which is attachable to and detachable from the printing apparatus, has two joint portions in its bottom portion. The joint portions are linked to a first hollow tube 8 and a second hollow tube 9, respectively, provided in the printing apparatus. The first hollow tube 8 and the second hollow tube 9 are each constructed of a metal needle. An upright wall 42 upstanding from a bottom surface of the ink tank is formed around the second hollow tube 9 in the ink tank 5. Detecting that the ink tank 5 has run short of ink can be accomplished by passing a trace of current through the first hollow tube 8 and the second hollow tube 9, and detecting an increase in resistance value of the current when the level of the amount of ink remaining is lower than the upright wall 42.

The second hollow tube 9 communicates with an atmosphere communicating chamber 6, and the ink tank 5 communicates with the atmosphere through an atmosphere communicating passage 7 in the atmosphere communicating chamber. In addition, communication between a bottom surface 45 of the ink tank 5 and a top surface 46 of a sub tank 4 having a constant volume is by way of the first hollow tube 8, and communication between the sub tank 4 and the printing head 1 is via the supply tube 2. The top surface of the sub tank 4 is formed of a sloping surface 49, the cross-sectional area of which becomes larger vertically and more downward, throughout substantially the entire area of the top surface, and the sub tank 4 is connected at the top surface 46 of the highest position to the first hollow tube 8. Then, a solid shaft 10 constructed of metal is provided in the sub tank 4. Whether the sub tank is full of ink is detected by the resistance value when a feeble current is passed through the first hollow tube 8 and the solid shaft 10. An ink outlet from the sub tank 4 is provided in a side surface 47 at its lowest position 48. An ink reservoir unit (or an open/close valve 3) formed of a flexible member having a variable volume, which is capable of opening and closing a supply flow path, is provided between the sub tank 4 and the supply tube 2. The open/close valve 3 is biased in a normally open direction by a compression spring 38, and is closed by rotating about a center shaft 40 by a cam 37 pressing a lever 39. The cam 37 is configured to be capable of positioning by a photosensor 41, and is controlled and rotated through a gear 36 by a DC motor 35 as a driving source. The levers 39 for all colors of ink are linked together, and the open/close valves 3 for all colors of ink are subject to open/close control by the single motor 35 at the same time.

Next, description will be given with regard to the valve-closing sucking for forcefully removing air in the printing head 1 when the air is accumulated in the printing head 1. An ink flow path is closed by the open/close valve 3 provided in the supply flow path, a cap is brought into intimate contact with the nozzle face surface by the recovery unit 70, and the air is sucked in by a pump. The air in the printing head 1 is forcefully removed by suction for a certain time (e.g. about 25 seconds in the embodiment), and after that, the ink flow path is opened by the open/close valve 3. By opening the ink flow path, the ink is supplied from the ink tank 5, and the inside of the printing head 1 is filled with a specified amount of ink. In the embodiment, the removal of the air in the printing head 1 requires the open/close valve 3 for closing and opening the ink supply flow path. The valve-closing sucking is utilized also for initial filling. At the time of the initial filling, upon detection of attachment of the ink tank 5, the valve-closing sucking is first repeated several times (e.g. four times in the embodiment), and then, ink filling from the sub tank 4 to the printing head 1 can be effected by performing sub tank filling control to be described later with reference to FIG. 5B.

Figure 3:
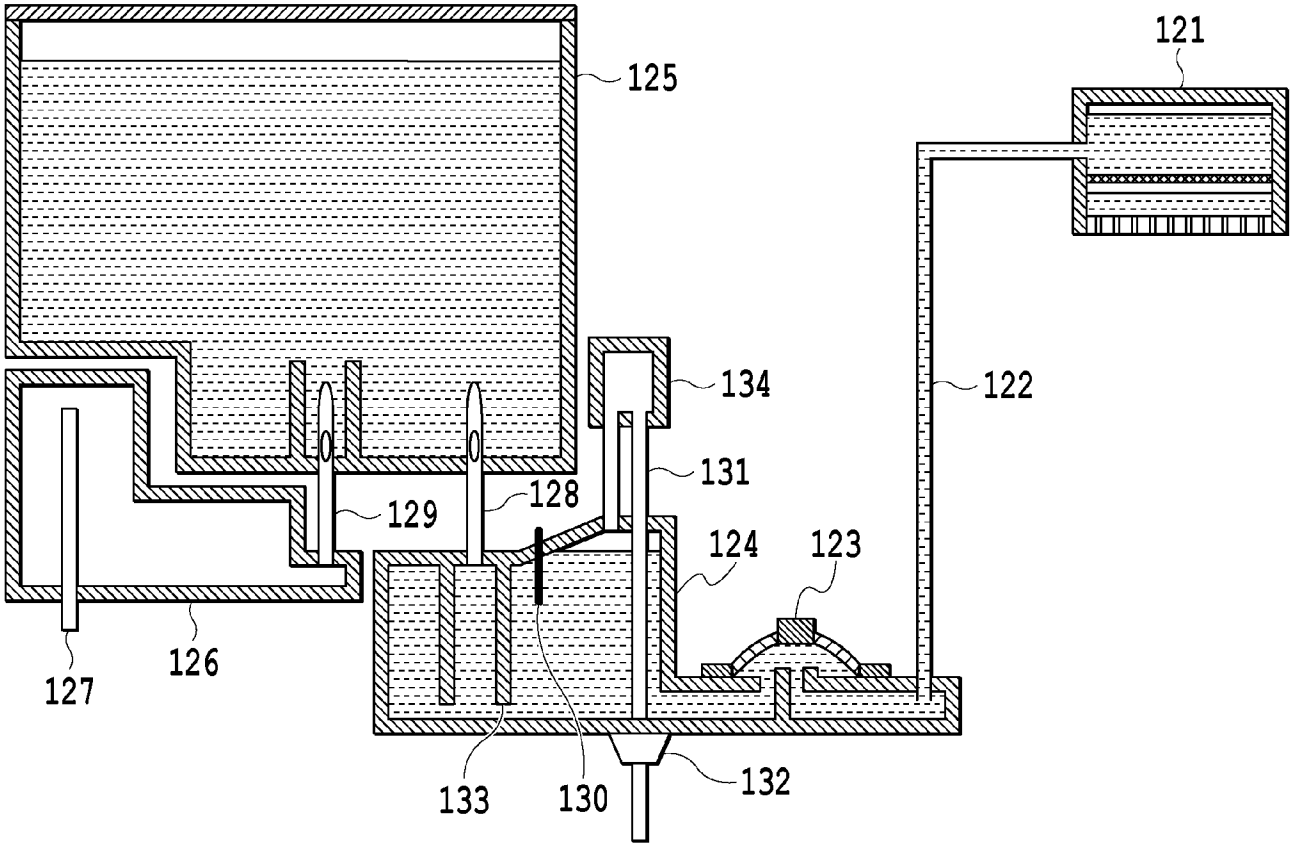
FIG. 3 is a conceptual drawing illustrating a flow path for a color of ink in a conventional ink supply device.

FIG. 3 is a conceptual drawing illustrating a flow path for a color of ink in a conventional ink supply device. In the conventional flow path, a sub tank 124 communicates with an ink tank 125 and a flow path 122 to a printing head 121, and, in addition, a top surface of the sub tank has an atmosphere communicating passage 131 as a flow path for air vent for removal of air in the sub tank. Since it is desired to remove the air in the sub tank as much as possible, a portion of connection of the atmosphere communicating passage to the sub tank is disposed at the highest position of the top surface of the sub tank. Then, the top surface of the sub tank has a shape such that its cross-sectional configuration becomes larger in area vertically and more downward from the portion of connection to the atmosphere communicating passage. In addition, the portion of connection of the atmosphere communicating passage 131 to the sub tank 124 is disposed at a position vertically higher than a bottom surface of a second hollow tube 129 as a head reference. Thereby, even if more filling operations than necessary are repeated at the time of the removal of the air in the sub tank (or the filling of ink into the sub tank), the ink is prevented from overflowing the atmosphere communicating passage and leaking out therefrom.

In addition, the atmosphere communicating passage 131 is provided with a space chamber 134 having a certain volume, so as to prevent the ink from leaking out via the atmosphere communicating passage even if the ink flows flashing into the sub tank. Then, the atmosphere communicating passage 131 is provided with an atmosphere communicating valve 132 for closing off and opening communication with the atmosphere. The filling of ink from the main tank into the sub tank is accomplished by performing alternately opening and closing operations of an open/close valve 123 for the flow path and the atmosphere communicating valve 132.

In addition, agitation of the main tank and the sub tank is accomplished by closing the atmosphere communicating valve 132, and bringing the open/close valve 123 for the flow path into opening and closing operations and thereby producing a flow of ink in the ink tank and the sub tank.

In the conventional printing apparatus, however, air is always present between the sub tank and the atmosphere communicating valve. Therefore, even if an attempt is made to stir the ink by producing the flow in the main tank and the sub tank by opening and closing the open/close valve, the air between the sub tank and the atmosphere communicating valve acts as a damper to reduce stirring efficiency. Consequently, the flow takes place unsuccessfully in the ink tank, resulting in insufficient stirring. Printing using the ink in the ink tank causes unevenness in density in a printed image and hence degradation of printing quality.

Figure 4:
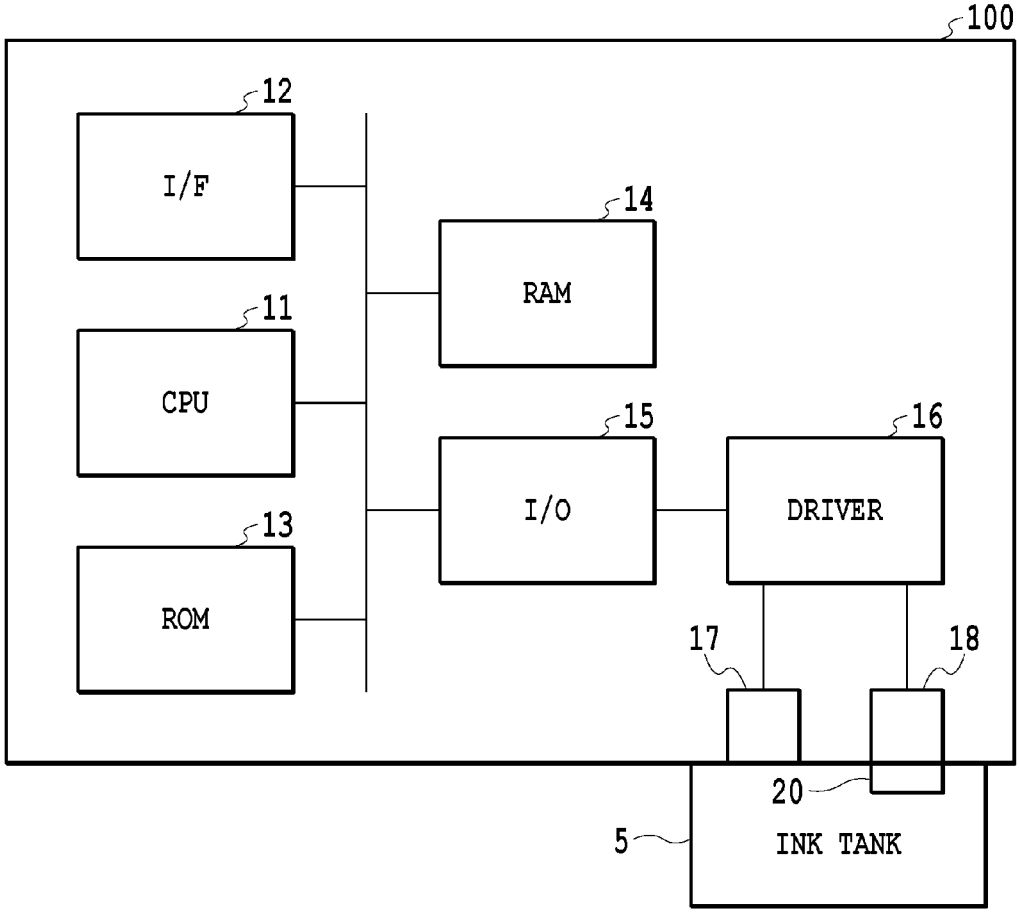
FIG. 4 is a block diagram illustrating an internal configuration of the inkjet printing apparatus of the embodiment.

FIG. 4 is a block diagram illustrating an internal configuration of the inkjet printing apparatus of the embodiment. The printing apparatus 50 includes a CPU (central processing unit) 11 for controlling the printing apparatus, a user interface 12 including keys for the user to do operations and the operating panel for displaying information, ROM (read only memory) 13 having control software built-in, and RAM (random access memory) 14 which is temporarily used to run the control software. Moreover, the printing apparatus 50 includes a I/O (input/output) 15, a driver 16, and a remaining ink quantity sensor 17 for detecting the amount of ink remaining in the ink tank. An ink tank attachment sensor 18 for detecting the attachment or detachment of the ink tank makes a decision based on readings on EEPROM (electrically erasable programmable read-only memory) 20 attached to the ink tank. The ink tank attachment sensor 18 is used for reading and writing of the contents of the EEPROM 20.

FIGS. 5A and 5B are flowcharts illustrating a flow of nonstop printing control of the embodiment. FIG. 5A illustrates a sequence of the overall nonstop printing control, and FIG. 5B illustrates a sequence of the sub tank filling control required for the nonstop printing control.

When the ink tank 5 has run out of ink, ink in the sub tank 4 can be used to continue printing, and, when the ink in the sub tank 4 is consumed, air is led from the atmosphere communicating passage 7 via the ink tank 5 into the sub tank 4. The introduced air is accumulated above the sub tank 4 to thus break ink connection between the first hollow tube 8 and the solid shaft 10 and hence render it difficult for a current to flow. As a result, the ink in the sub tank 4 can be detected being consumed (at step S201). The detection of consumption of the ink in the sub tank 4 indicates that the ink tank 5 is empty, and the user is notified by the operating panel that the ink tank is empty (at step S202).

Figure 6:
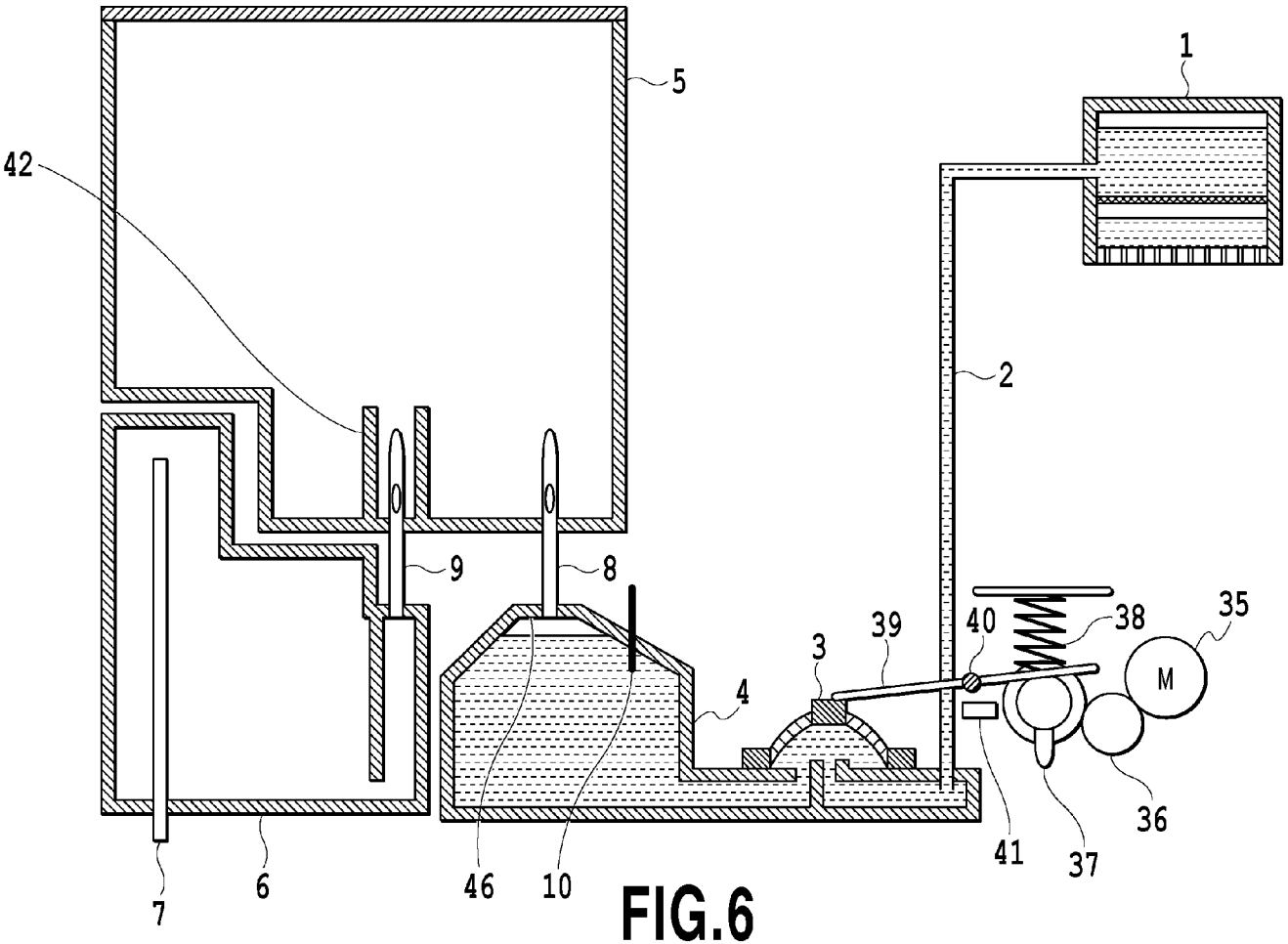
FIG. 6 is a conceptual drawing of a flow path, illustrating a condition where nonstop printing of the embodiment is performed.

FIG. 6 is a conceptual drawing of a flow path, illustrating a condition where the ink in the ink tank 5 of the inkjet printing apparatus of the embodiment is used up and the ink in the sub tank 4 is used to perform printing (i.e. nonstop printing). As illustrated in FIG. 6, the air is led from the atmosphere communicating passage 7 via the ink tank 5 into the sub tank 4. Therefore, the ink connection between the first hollow tube 8 and the solid shaft 10 is broken, and thus, it can be seen that the ink in the sub tank 4 is consumed.

Referring again to FIG. 5A, until the ink tank 5 is replaced, image formation is enabled and continued until the available permissible amount of ink in the sub tank 4 (e.g. about 11 ml in the embodiment) is reached.

The consumable permissible amount of ink in the sub tank 4 is stored beforehand in the printing apparatus, and the amount of ink consumed is calculated by counting the number of ejections from the printing head. The amount of ink consumed is compared to the permissible amount, and printing is enabled if the amount of ink consumed is equal to or less than the permissible amount. If the amount of ink consumed exceeds the permissible amount, the printing is stopped, and the printing apparatus waits for replacement of the ink tank 5, while notifying the user that the ink tank 5 is empty. In the embodiment, a configuration is such that the amount of ink ejected is converted to the amount of ink consumed to determine whether or not the amount of ink consumed exceeds the available permissible amount of ink in the sub tank 4; however, a configuration may be such that ink end detecting means is provided in the sub tank 4.

Incidentally, in the embodiment, the available permissible amount of ink in the sub tank is set to about 11 ml; however, it is to be understood that the present invention is not so limited. In the printing apparatus, the available permissible amount is the amount of ink capable of printing of at least one sheet of printing medium when printing is performed at a density of 100% on a printing medium of maximum size.

When the ink tank is replaced before the available permissible amount of ink in the sub tank 4 is used up (at step S203) and page printing is stopped (at step S204), ink is filled into the sub tank 4 before the next printing is started (at step S205). Upon completion of the filling of the ink, the next printing is started. When the available permissible amount of ink in the sub tank is used up (at step S206), the printing is immediately stopped (at step S207), and a warning is issued to urge the user to replace the ink tank (at step S208). The reason is that, if the printing is not stopped, air flows from the sub tank 4 via the ink supply flow path into the printing head 1 and, consequently, ink ejection takes place unsuccessfully, resulting in poor printing.

Figure 7A:
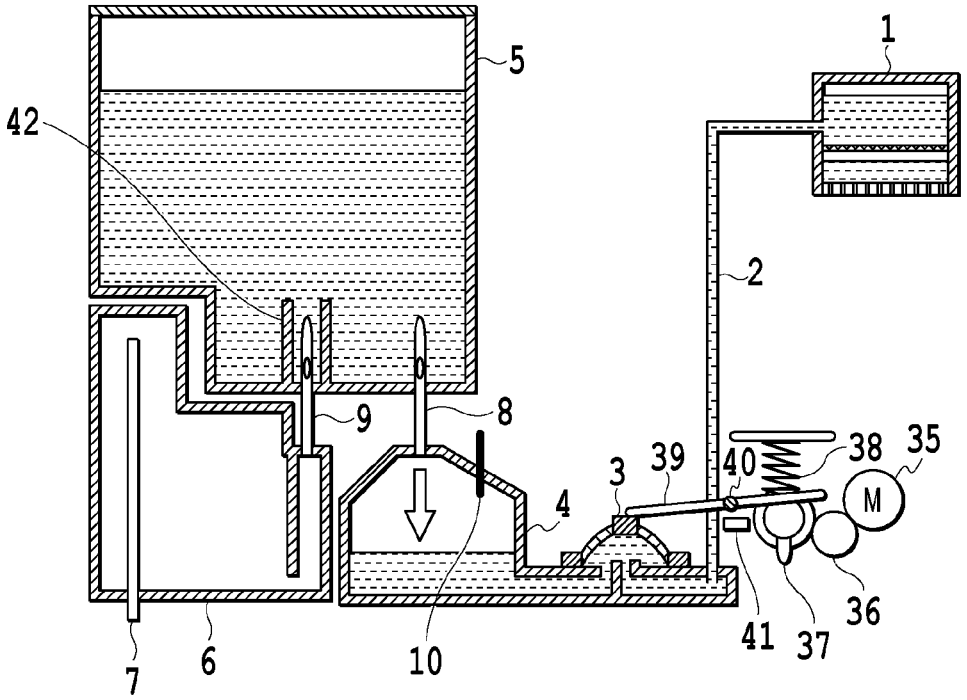
FIGS. 7A and 7B are conceptual drawings illustrating a flow path under operation for filling ink into a sub tank of the embodiment.
Figure 7B:
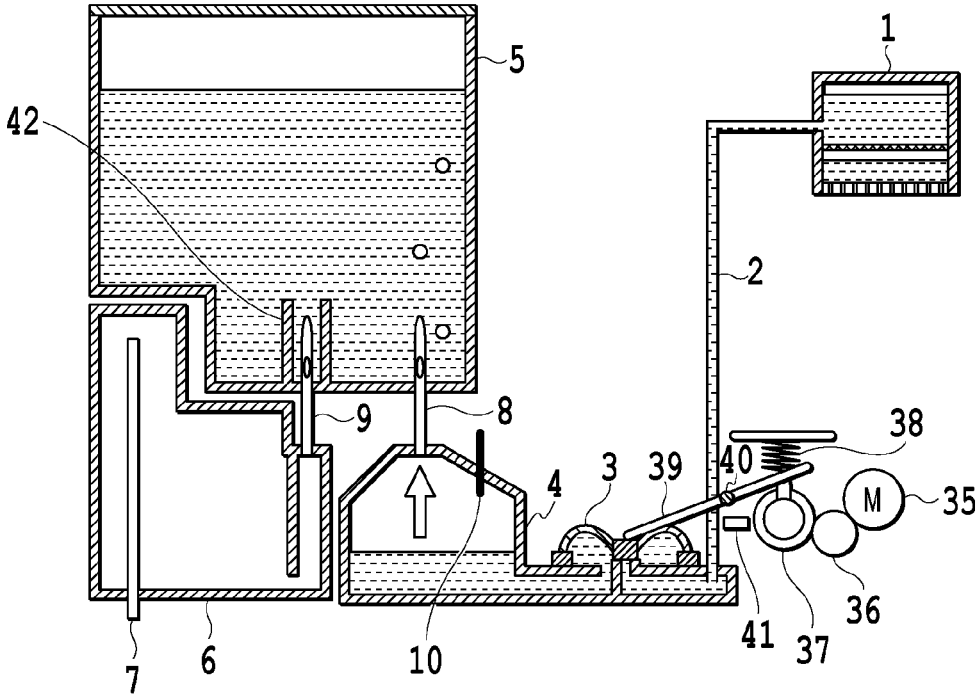

FIGS. 7A and 7B are conceptual drawings illustrating an ink flow path, which are useful in explaining operation for filling ink from the ink tank 5 into the sub tank 4 in the embodiment. Specifically, FIGS. 7A and 7B illustrate a condition after replacement of the ink tank 5. FIG. 7A illustrates a condition where the open/close valve is operated to change from a closed position to an open position, and FIG. 7B illustrates a condition where the open/close valve is operated to change from the open position to the closed position.

Referring first to FIG. 7A, a configuration is such that the following relationship is established: V1>V2, where V1 denotes the volume of the open/close valve 3 (e.g. about 0.45 ml in the embodiment) and V2 denotes the volume of the first hollow tube 8 (e.g. about 0.09 ml in the embodiment). When the open/close valve 3 is operated to change from the closed position to the open position, ink in an amount corresponding to the volume (V1−V2) (i.e. about 0.36 ml) can be drawn from the ink tank 5 into the sub tank 4. The reason is that no ink is present in the first hollow tube 8. This volume is represented as V3 (=V1−V2). At this time, air in an amount corresponding to the volume V3 is drawn from the atmosphere communicating chamber 6 into the ink tank 5.

Then, as illustrated in FIG. 7B, the cam 37 is rotated by the DC motor 35 so that the lever 39 presses the open/close valve 3 to change it from the open position to the closed position, and thereby, air in the sub tank 4, in an amount corresponding to the volume V3, is forced out of the sub tank 4 and into the ink tank 5. The reason is that the first hollow tube 8 is full of ink. At this time, ink in an amount corresponding to the volume V3 is forced out of the ink tank 5 and into the atmosphere communicating chamber 6.

In other words, the ink is supplied from the sub tank 4 to the printing head by increasing the amount of air in the open/close valve, and the air in the sub tank 4 is sent to the main tank by reducing the amount of air in the open/close valve.

A pressure loss in the ink supply flow path from the open/close valve 3 to the printing head 1 is far greater than a pressure loss from the open/close valve 3 to the ink tank 5, and therefore, little ink flows toward the printing head 1. After that, the cam 37 is rotated again by the DC motor 35 so that the lever 39 is biased by the compression spring 38 to change the open/close valve 3 from the closed position to the open position. At this time, ink in an amount corresponding to the volume V3 is drawn from the atmosphere communicating chamber 6 into the ink tank 5, and also, ink in an amount corresponding to the volume V3 is drawn from the ink tank 5 into the sub tank 4. After that, the DC motor 35 is activated again to change the open/close valve 3 from the open position to the closed position. The opening and closing operations of the open/close valve are repeatedly controlled (at step S301).

Whether the sub tank 4 is filled with ink is checked for each opening and closing operation (at step S302). When the sub tank 4 is not filled with ink, whether ink is present in the ink tank 5 is checked (at step S304). When the sub tank 4 is filled with ink, the opening and closing operations are repeated. When a decision is made that no ink is present in the ink tank 5, a warning is issued to urge the user to replace the ink tank (at step S305). When the ink tank is replaced (at step S306), the opening and closing operations of the open/close valve 3 are repeated again. Determining whether ink is present in the ink tank 5 is accomplished by passing a trace of current through the first hollow tube 8 and the second hollow tube 9, and determining whether ink is present in an amount equal to or more than a predetermined amount, from the resistance value of the current. When the amount of ink is equal to or less than the predetermined amount, a decision is made based on the amount of ink remaining, written in the EEPROM 20 of the ink tank 5. When the amount of ink is equal to or less than the predetermined amount, an approach for making a decision is as given below.

In the embodiment, ink in an amount corresponding to the volume V3 (i.e. about 0.36 ml) can be introduced from the ink tank 5 into the sub tank 4 by a single opening and closing operation of the open/close valve 3, and thus, a decision is made by performing calculation based on the amount written in the EEPROM 20.

Whether the sub tank 4 is full of ink can be determined by the resistance value when a trace of current is passed through the first hollow tube 8 and the solid shaft 10 provided in the sub tank 4. After the sub tank 4 has been detected being full of ink (at step S302), the opening and closing operations of the open/close valve are performed three times as a margin (at step S303). Once the sub tank is filled with ink, ink in an amount corresponding to the volume V1 of the open/close valve 3, thereafter, merely flows out of or into the atmosphere communicating chamber 6 and the sub tank 4, and there is no change in the amount of ink in the ink tank and the sub tank. Therefore, when the sub tank is filled with one color of ink by a small number of opening and closing operations and the sub tank is not yet filled with another color of ink, even if open/close valve control is performed for the filling of the latter color of ink, the problem of the ink overflowing or the like does not arise.

Description has been given with regard to the sequence of the filling of ink into the sub tank for a color of ink; however, at the time of filling of a plurality of colors of ink, the open/close valve control is performed until the sub tank is filled with a color of ink which requires the largest number of opening and closing operations. Moreover, for the color of ink which requires the largest number of opening and closing operations, the opening and closing operations are performed three times as the margin. The number of opening and closing operations may vary according to the volume of the open/close valve or the like.

Figure 8A:
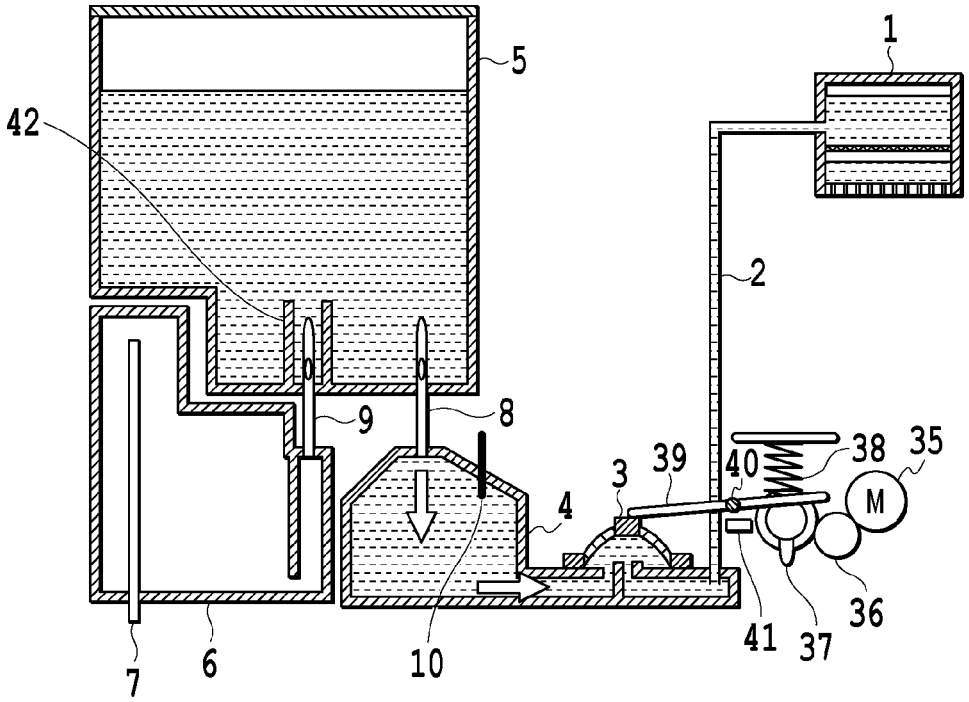
FIGS. 8A and 8B are conceptual drawings illustrating an ink flow path, which are useful in explaining stirring operation of the embodiment.
Figure 8B:
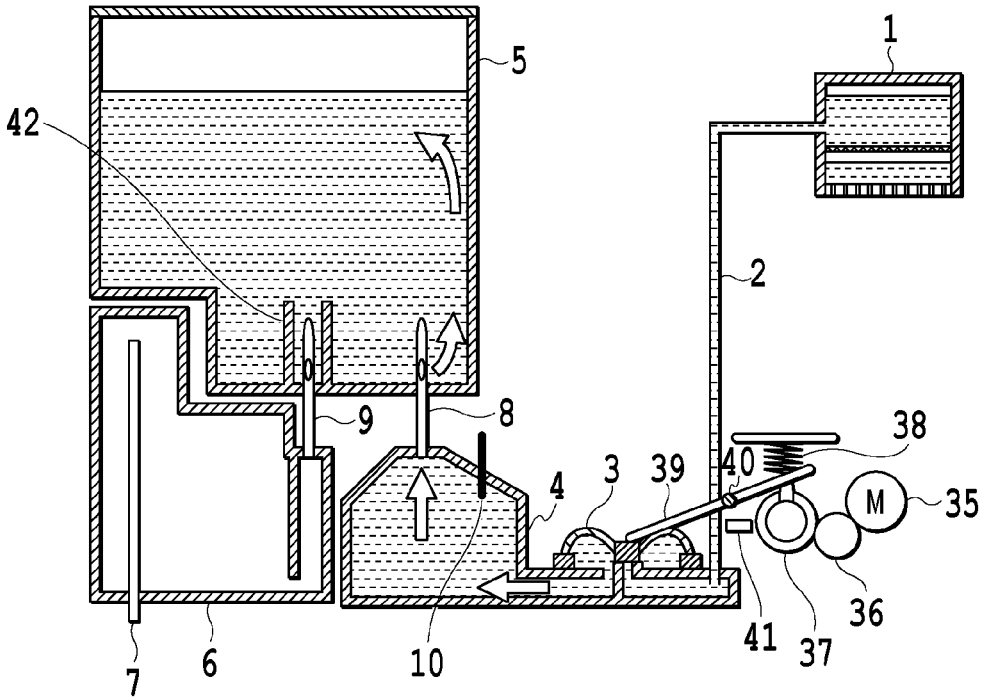

FIGS. 8A and 8B are conceptual drawings illustrating an ink flow path, which are useful in explaining stirring operation of the embodiment. FIG. 8A illustrates a condition where the open/close valve is operated to change from the closed position to the open position, and FIG. 8B illustrates a condition where the open/close valve is operated to change from the open position to the closed position.

Figure 9:
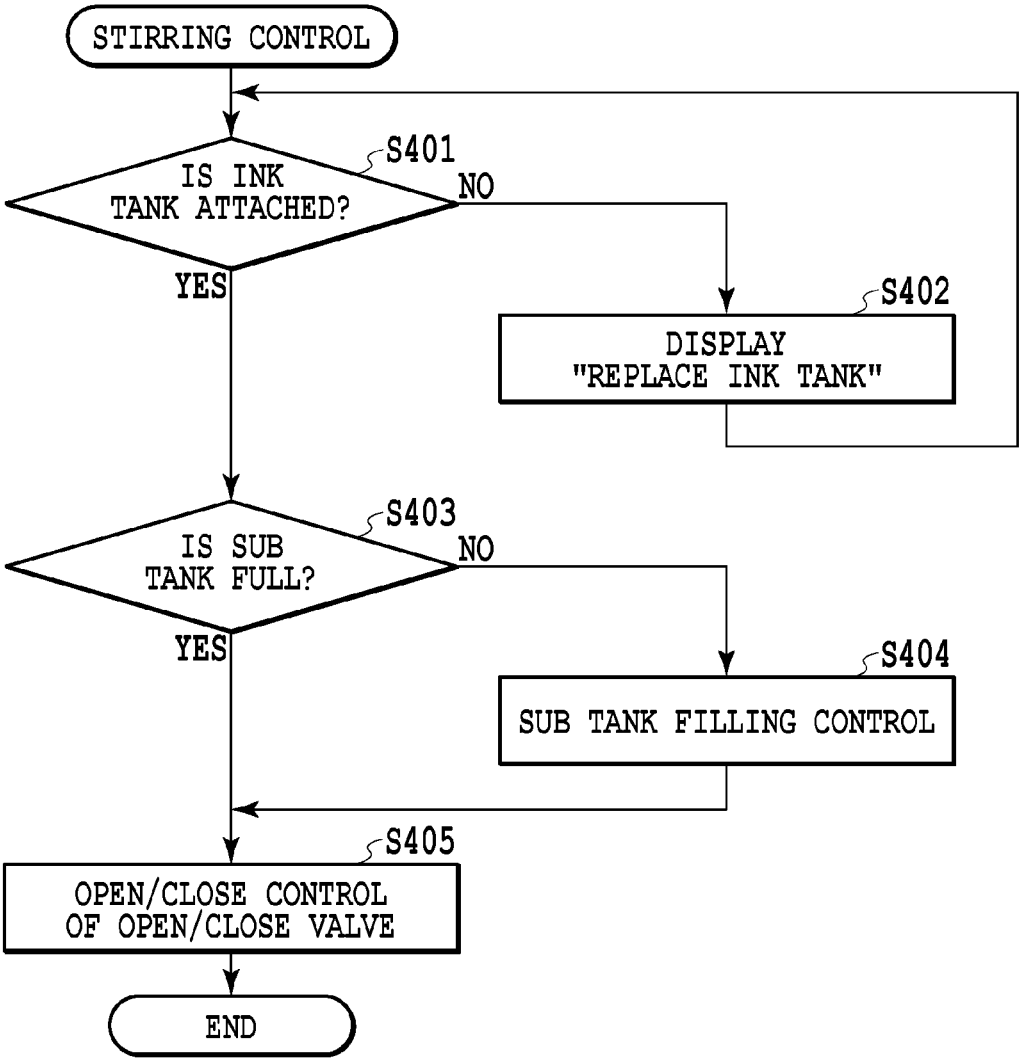
FIG. 9 is a flowchart illustrating a flow of the stirring operation of the embodiment.

FIG. 9 is a flowchart illustrating a flow of the stirring operation of the embodiment.

At the time of stirring, first, whether the ink tank is attached is checked (at step S401), and, when the ink tank is not attached, a warning is issued to urge the user to attach the ink tank (at step S402). After the detection of attachment of the ink tank, whether the sub tank 4 is full of ink is checked (at step S403). When the sub tank 4 is not full, the sub tank filling control is performed (at step S404). The sub tank filling control is as described by using FIG. 5B.

When the sub tank 4 is full of ink, the stirring operation is performed by open/close control of the open/close valve 3 (at step S405). As illustrated in FIG. 8A, when the open/close valve 3 is operated to change from the closed position to the open position, ink in an amount corresponding to the volume V1 as the amount of change in the volume of the open/close valve is drawn from the ink tank 5 via the sub tank 4 into the open/close valve 3. At this time, air or ink is drawn from the atmosphere communicating chamber 6 also into the ink tank 5. After that, as illustrated in FIG. 8B, when the open/close valve 3 is operated to change from the open position to the closed position, ink in an amount corresponding to the volume V1 as the amount of change in the volume of the open/close valve flows into the ink tank 5 via the sub tank 4. At this time, ink flows from the ink tank 5 into the atmosphere communicating chamber 6. The ink flows into the ink tank 5 thereby to produce a flow of the ink in the ink tank 5. At the same time, a flow of the ink is produced also in the sub tank 4. The opening and closing operations are repeated thereby to enable continuously producing the flow and thus stirring the ink in the ink tank 5 and the ink in the sub tank 4.

At this time, as in the case of the filling of ink into the sub tank 4, the pressure loss in the ink supply flow path from the open/close valve 3 to the printing head 1 is far greater than the pressure loss from the open/close valve 3 to the ink tank 5, and therefore, little ink flows toward the printing head 1. As a result, ink in an amount corresponding to the amount of change in the volume of the open/close valve 3 flows into and out of the ink tank 5, so that the ink in the ink tank 5 can be stirred with little loss.

In the embodiment, three types of stirring timings are set according to the period of time during which the ink is left as it is. When the period of time is within 10 days, the opening and closing operations are performed about 100 times. When the period of time is between 10 days inclusive and 20 days exclusive, the opening and closing operations are performed about 200 times. When the period of time is equal to or more than 20 days, the opening and closing operations are performed about 400 times.

In the conventional structure, the percentage of air to the volume of the sub tank is about 10%. Meanwhile, in the structure of the embodiment, the amount of ink flowing into the ink tank by a single opening and closing operation of the open/close valve is about 1.3 times that of the conventional structure. As a result, in the conventional structure, the contents of the ink tank can be stirred in the neighborhood of 150 ml, whereas in the structure of the embodiment, the contents of the ink tank can be stirred in the neighborhood of 300 ml.

As described above, the sub tank is not provided with an atmosphere communicating passage and an air chamber, and thereby, it is possible to achieve a stirring effect with efficiency and also achieve adaptation to a large-sized ink tank.

Incidentally, in the embodiment, detecting that the ink tank 5 has run short of ink is accomplished by detection using an electrode, and what is called a dot count method which involves counting the number of ejections from the printing head. However, other methods such as a float method and an optical method may be used to detect that the ink tank 5 has run short of ink. In the embodiment, likewise, the detection using the electrode and the dot count method are used for the detection of the "full" state of the sub tank 4 and the ink end detection in the sub tank 4; however, other methods may be used for the detection.

Moreover, in the embodiment, the ink reservoir unit is configured as the open/close valve; however, the ink reservoir unit and the open/close valve may be provided separately. In this case, it is desirable that the ink reservoir unit be disposed between the sub tank and the open/close valve. The ink reservoir unit may be in the form of bellows or in the form of a diaphragm, or may be formed of a flexible member having a variable volume.

By the structure of the embodiment, the sub tank can be filled with ink, and thus, space efficiency is improved, so that the minimum size required for attachment of the sub tank can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-052744, filed Mar. 9, 2012, which is hereby incorporated by reference herein in its entirety.

What is claimed is:

1. An inkjet printing apparatus comprising:

a printing head constructed to perform a printing operation;

a main tank storing ink to be supplied to the printing head and being attachable to and detachable from an apparatus body;

a sub tank constructed to temporarily store ink to be supplied from the main tank to the printing head; the sub tank having a top surface which includes a sloping surface;

a detecting device provided in the sub tank and configured to detect whether the sub tank is filled with ink;

an ink reservoir unit including a flexible member and disposed in an ink supply path downstream of the sub tank and upstream of the printing head;

a flow path constructed to connect the main tank with the sub tank, the flow path being connected to a highest position of the top surface of the sub tank; and a control unit constructed to execute a sub tank filling operation in which ink is supplied from the main tank to the sub tank through the flow path and in which air in the sub tank is supplied to the main tank through the flow path by changing the volume of the ink reservoir unit, wherein the entirety of the sub tank filling operation and the printing operations are executed under a state that the main tank is connected with the sub tank by the flow path.

2. The inkjet printing apparatus according to claim 1, wherein the volume of the flow path is smaller than the volume of the ink reservoir unit.

3. The inkjet printing apparatus according to claim 1, wherein the ink reservoir unit includes an open/close valve constructed to open and close the ink supply path.

4. The inkjet printing apparatus according to claim 1, wherein when the detecting device detects that the sub tank is not filled with ink, the sub tank filling operation is executed by the control unit.

5. The inkjet printing apparatus according to claim 4, wherein the sub tank filling operation is repeatedly executed until the detecting device detects that sub tank is filled with ink.

6. The inkjet printing apparatus according to claim 1, further comprising a second detecting device to detect the attachment of the main tank, wherein the sub tank filling operation is executed when the second detecting device detects that the main tank is attached.

7. The inkjet printing apparatus according to claim 1, wherein the control unit executes the sub tank filling operation, in which ink is supplied from the main tank to the sub tank through the flow path, by increasing the volume of the ink reservoir unit.

8. The inkjet printing apparatus according to claim 1, wherein the control unit executes the sub tank filling operation, in which air in the sub tank is supplied to the main tank through the flow path, by reducing the volume of the ink reservoir unit.

9. The inkjet printing apparatus according to claim 1, wherein the control unit is further constructed to execute a stirring operation, in which ink flows back and forth between the main tank and the sub tank through the flow path, by changing the volume of the reservoir unit.

10. The inkjet printing apparatus according to claim 9, wherein the stirring operation is executed by the control unit when the sub tank filling operation is executed and the detecting device detects that the sub tank is filled with ink.

11. An inkjet printing apparatus comprising:

a printing head constructed to performing a printing operation;

a main tank storing ink to be supplied to the printing head and being attachable to and detachable from an apparatus body;

a sub tank constructed to temporarily store ink to be supplied from the main tank to the printing head, the sub tank having a top surface which includes a sloping surface;

a detecting a device provided in the sub tank and configured to detect whether the sub tank is filled with ink;

an ink reservoir unit including a flexible member and disposed in an ink supply path downstream of the sub tank and upstream of the printing head;

a flow path constructed to connect the main tank with the sub tank, the flow path being connected to a highest position of the top surface of the sub tank; and a control unit constructed to execute a sub tank filling operation in which ink is supplied from the main tank to the sub tank through the flow path and in which air in the sub tank is supplied directly from the sub tank to the main tank through the flow path by changing the volume of the ink reservoir unit, wherein the sub tank filling operation and the printing operation are being executed under a state that the main tank is connected with the sub tank by the flow path.

12. The inkjet printing apparatus according to claim 11, wherein the volume of the flow path is smaller than the volume of the ink reservoir unit.

13. The inkjet printing apparatus according to claim 11, wherein the ink reservoir unit includes an open/close valve constructed to open and close the ink supply path.

14. The inkjet printing apparatus according to claim 11, further comprising a second detecting device to detect the attachment of the main tank, wherein the sub tank filling operation is executed when the second detecting device detects that the main tank is attached.

15. The inkjet printing apparatus according to claim 11, wherein the control unit executes the sub tank filling operation, in which ink is supplied from the main tank to the sub tank through the flow path, by increasing the volume of the ink reservoir unit.

16. The inkjet printing apparatus according to claim 11, wherein the control unit executes the sub tank filling operation, in which air in the sub tank is supplied to the main tank through the flow path, by reducing the volume of the ink reservoir unit.

17. The inkjet printing apparatus according to claim 11, wherein the control unit is further constructed to execute a stirring operation, in which ink flows back and forth between the main tank and the sub tank through the flow path, by changing the volume of the reservoir unit.

18. The inkjet printing apparatus according to claim 17, wherein the stirring operation is executed by the control unit when the sub tank filling operation is executed and responsive to a detection that the sub tank is filled with ink.

* * * * *